US008240976B1

(12) United States Patent
Kamio

(10) Patent No.: US 8,240,976 B1
(45) Date of Patent: Aug. 14, 2012

(54) METHODS AND APPARATUS FOR CENTRIFUGAL PUMPS UTILIZING HEAD CURVE

(75) Inventor: Keijun Kamio, Sparks, NV (US)

(73) Assignee: EBARA International Corp., Sparks, NV (US)

( * ) Notice: Subject to any disclaimer, the term of this patent is extended or adjusted under 35 U.S.C. 154(b) by 730 days.

(21) Appl. No.: 12/381,941

(22) Filed: Mar. 18, 2009

(51) Int. Cl.
*F01D 29/70* (2006.01)

(52) U.S. Cl. ..... 415/1

(58) Field of Classification Search ..... 415/1, 199.3, 415/199.2, 209.1, 211.1, 58.5, 173.1
See application file for complete search history.

(56) References Cited

U.S. PATENT DOCUMENTS

| | | | | |
|---|---|---|---|---|
| 4,781,531 | A * | 11/1988 | James | 415/199.1 |
| 4,981,414 | A | 1/1991 | Sheets | |
| 5,286,102 | A | 2/1994 | Veres | |
| 5,310,309 | A * | 5/1994 | Terasaki et al. | 415/208.3 |
| 5,330,318 | A | 7/1994 | Ogawa | |
| 5,383,764 | A | 1/1995 | Ogawa et al. | |
| 6,068,444 | A * | 5/2000 | Sheth | 415/199.2 |
| 6,290,460 | B1 * | 9/2001 | Nagaoka et al. | 415/208.2 |
| 6,371,724 | B2 * | 4/2002 | Nagaoka et al. | 415/208.3 |
| 6,406,277 | B1 * | 6/2002 | Shafer et al. | 417/424.2 |
| 6,514,034 | B2 | 2/2003 | Okamura et al. | |
| 6,547,514 | B2 * | 4/2003 | Lee | 415/1 |
| 6,695,579 | B2 | 2/2004 | Meng | |
| 6,699,008 | B2 | 3/2004 | Japikse | |
| 6,736,594 | B2 | 5/2004 | Irie et al. | |
| 6,923,621 | B2 | 8/2005 | Sato | |
| 8,070,426 | B2 * | 12/2011 | Brunner et al. | 415/174.3 |
| 2004/0071545 | A1 * | 4/2004 | Sato | 415/119 |

(Continued)

OTHER PUBLICATIONS

1999 German Publication of Gulich pp. 353/354: 7.9 and 7.91 re Radial Diffusers: German and translation.

(Continued)

*Primary Examiner* — Alexander Gilman
(74) *Attorney, Agent, or Firm* — Edward J. DaRin, Inc.; Edward J. DaRin

(57) ABSTRACT

Centrifugal Pumps are known to exhibit unstable operating region(s) in flow as evidenced by unstable operating region(s) in flow as evidenced by the pump's flow-head curve that has either a flat or a positive slope. The unstable flow has been determined to be due to the generating of a vortex and appears in the cross-over pass located downstream of the pump impeller in the area where the flow direction changes or bends for entry into the diffuser, specifically an axial diffuser with blades. Once the flow-head curve for a selected centrifugal pump is plotted, the unstable area is manipulated by the use of tandem vane devices to eliminate the unstable regions of the flow head curve. These vane devices may be the full height or partial height vanes sized on the basis of the cross-over path for guiding the fluid stream from the pump impeller into the diffuser smoothly including a change in direction. A small axial gap is defined between the tandem vane and the downstream axial diffuser vanes. The tandem vane has its leading edge skewed a pre-selected amount for introducing a twisting movement into the fluid stream to reduce any vortices or eddies in the fluid stream to thereby causing the unstable area(s) of the flow-head curve to exhibit stable operation by the modified flow-head curve that is continuously rising toward pump shut-off. Since the various parameter for the vane devices are dependent on the design of the selected pump's impeller and the design of the diffuser blades, these must be experimented with to achieve the best flow rates.

22 Claims, 11 Drawing Sheets

U.S. PATENT DOCUMENTS

| | | | | |
|---|---|---|---|---|
| 2005/0175450 | A1* | 8/2005 | Okubo et al. | 415/220 |
| 2006/0204359 | A1* | 9/2006 | Semple et al. | 415/170.1 |
| 2007/0217909 | A1* | 9/2007 | Aki et al. | 415/208.3 |
| 2009/0155064 | A1* | 6/2009 | Brown et al. | 415/199.6 |

OTHER PUBLICATIONS

LNG: Basics of Liquefied Natural Gas, pp. 64 and 65, University of Texas at Austin, 2007.

* cited by examiner

METHODS AND APPARATUS FOR CENTRIFUGAL PUMPS UTILIZING HEAD CURVE

RELATED APPLICATION

Priority is claimed on the basis of the Provisional Application bearing Ser. No. 61,069,992 filed on Mar. 18, 2008 and entitled "Devices for Head Curve stabilization in Centrifugal Pumps Using Axial Diffusers".

BACKGROUND OF THE INVENTION

The essential parts of a conventional centrifugal pump comprises a rotating member with blades or vanes referred to in the art as an impeller and a housing or casing to surround it. The centrifugal pump depends upon centrifugal forces or a variation of pressure due to the rotation of the impeller. The discharge of the fluid from a centrifugal pump is relatively smooth and steady and can handle various liquids and liquids containing solids such as sand, gravel and stones of various types, of moderate size. Centrifugal pumps are classified as volute type or diffuser type. In the diffuser type there is provided a series of fixed vanes for receiving the fluid discharged from the impeller so as to reduce the velocity of the received fluid by decreasing the Kinetic energy of the fluid stream and converting it to static pressure in the diffuser. It has been found that the centrifugal pump is best suited for producing relatively high pressure and low rates of flow permitting pressure regulation of the pumps.

Vertical cryogenic submerged motor pumps are commonly employed in the liquefied cryogenic gas industry. To this end, they are most prominent in the liquid hydrocarbon industry for liquefied natural gas, LNG, liquefied ethane gas, and liquefied propane and butane gas. There are two categories of LNG pumps that may be classified as the basis of their locations such as In-tank type versus vessel mounted or canned pumps. These categories are described and illustrated in the text entitled "LNG: Basics of Liquefied Natural Gas on pages 64 and 65 discussing "LNG Pumps" published by the University of Texas at Austin in 2007. The In-tank and marine style of the pumps sit at the bottom of large 40 to 60 meter tall cryogenic liquid storage tanks. To mount these pumps in the tall tanks, a 40 to 60 meter pipe column or mast arrangement is applied inside where the pump sits. To keep costs low, it is imperative to keep the pipe column size small and therefore reduce the radial size of the pump's geometry. This fact drives column mounted cryogenic pumps to use axial style diffusers. The prior art generally utilizes a radial vane diffuser downstream of the centrifugal pump. The geometric space restrictions of such an installation dictate the use of axial vane diffusers to save radial space and hence column size and costs.

The function of the diffuser in combination with the centrifugal pump is to efficiently convert the Kinetic energy of the fluid stream from the pump's impeller to pressure energy. The diffuser element is a critical fluid element in the pump responsible for approximately 20-40% of the pump head generated. It is known in the art that the diffuser has substantial influence on the shape of the head curve as the liquid flow rate is varied. Some axial type diffusers utilized with an inducer are known to exhibit unstable or somewhat flat head curves, some exhibit instabilities or flow regions where the slope of the head curve is positive. Pressure regulation is a common means of controlling the centrifugal pump and to be effective it is necessary to have a stable, continuously rising to shut off, head curve for many cryogenic pump applications.

Accordingly, when a pump exhibits a head curve with such instability it is useful to manipulate the axial head curve to bring it within a stable, continuously rising curve to shut off to permit pressure regulation of the pump.

Various attempts to improve the shape of the flow-head curve in centrifugal pumps have previously been made. Recent research has revealed that the unstable fluid flow in the pumps is due to the generation of a vortex that resides in the cross-over path located downstream of the pump impeller discharge at the location where the flow direction is changing by being bent for entry into the axial diffuser. A prior art search has revealed various prior art patents attempting to improve the flow-head characteristic of the centrifugal pump. A basic German publication has a brief discussion of radial diffusers with and without return vanes. The article discusses pumps with one stage, the diffuser discharge into a spiral shaped housing or into a ring shaped housing. Multistage pumps are integrated with return vanes that guide the fluid to the next stage, with the exception of the last stage of the multistage pumps.

U.S. Pat. No. 4,981,414 of H. E. Sheets is entitled Method and Apparatus For Producing Fluid Pressure and Controlling Boundary Layer. This patent is directed to turbo machinery having cascade type blades as used on a compressor, blower or turbine and the like. The article describes pressurization by use of a stationary cascade and controlling incentive angle. It does not appear that a solution for surge, span stall, stall cell and inception stall is disclosed.

U.S. Pat. No. 5,286,162 of J. P. Veres is directed to a method of reducing Hydraulic Instability for a centrifugal, volute type pump and compressor by the addition of bleed holes at the volute tongue of the casing of the pump for controlling boundary layer, as Illustrated in FIG. 1.

The search also revealed the disclosure of a centrifugal pump with an improved Axial Diffuser in U.S. Pat. No. 5,330,318 of Ogawa. The teachings are directed to the selection of a specific incident angle of the axial diffuser vanes. It does not appear that this will eliminate unstable conditions sought by the Applicant herein.

U.S. Pat. No. 5,383,764 discloses a diffuser pump having vane blades constructed in two sections for eliminating secondary flow between the sections. This structure may not eliminate an unstable condition.

U.S. Pat. No. 6,923,621 discloses a diffuser for a Turbo pump for suppressing degradation in efficiency while preventing the diffuser from stalling a turbo pump. This is similar in structure to the disclosure in U.S. Pat. No. 5,383,764 and involves an opening at a selected location of a vane to control boundary and prevent separation or a vortex.

U.S. Pat. No. 6,695,579 discloses a diffuser having a variable blade height by providing a flow section profile with increasing cross-section area to cause uneven flow velocity and cause secondary flow in the channel. Totally different approach from subject invention.

U.S. Pat. No. 6,699,008 of D. Jopikse discloses a Flow Stabilizing Device. The disclosure utilizes a vaneless diffuser and provides a slot in front of the inducer and flow back to the inlet in order to eliminate a vortex at a certain flow. This flow is introduced to the outlet of the impeller in an attempt to flush the vortex generated at the cavity between the impeller and diffuser. The disclosure cannot generate a high pressure larger than that generated by the impeller. The flow direction is reverse direction from that of the impeller but the disclosure drawing incorrectly shows the reverse flow.

U.S. Pat. No. 6,514,034 of Okamura et al discloses a pump which is small-sized without increasing the RPM of the impeller while suppressing the unstable portion of the pump head curve due to separation and/or stalling within the region of low flow rate by the provision of a number of grooves in a direction of the pressure gradient of the fluid. This technique is applicable to an axial impeller a device not utilized in the Applicant's invention.

U.S. Pat. No. 6,736,594 is similar to the above described U.S. Pat. No. 6,514,034 by the provision of a slot in the casing that is adjustable so that the recirculation is eliminated.

SUMMARY OF THE INVENTION

Although the present invention is useful to a large extent as a Liquefied Natural Gas, LNG, pump in both the In-tank type and pot type of installations, the concepts disclosed by the present invention are directly applicable to all centrifugal pumps wherever employed and should be so considered in evaluating the present invention. In the construction of the centrifugal pumps the pump impeller is generally spaced from the axial diffuser by a cross-over gap that must be traversed by the fluid stream exiting the impeller so that it can be driven through the cross-over gap and caused to change in direction for entering the diffuser. In accordance with the present invention, this is accomplished by the addition of a tandem vane as an extension for the axial diffuser vane and receives the fluid stream from the impeller and guides the fluid through the cross-over gap including the necessary change in direction of the fluid. The exit area of the tandem vane has pre-selected angular relationship for twisting the fluid as it exits the tandem vane for minimizing any turbulence in the fluid stream occurring at the impeller. The extension vanes themselves are made up of a metal with a smooth surface and fixed on the pump casing or diffuser by bolts and circumferentially aligned with the diffuser or separately mounted in the cross-over gap between the centrifugal impeller and axial diffuser to guide the fluid flow from the impeller into the axial diffuser for making the direction change in the meridian flow direction less abrupt. The various embodiments include other geometric variations to achieve the same stabilizing function by manipulating the flow in the cross-over gap between the impeller and the axial diffuser. At the present time, the various means of modifying the head curve must be tried to determine the best technique for stabilizing the head curve.

BRIEF DESCRIPTION OF THE SEVERAL VIEWS OF THE DRAWINGS

These and other features of the present invention may be more fully appreciated when considered in the light of the following specification and drawings, in which.

DETAILED DESCRIPTION OF THE INVENTION

Figure 14:
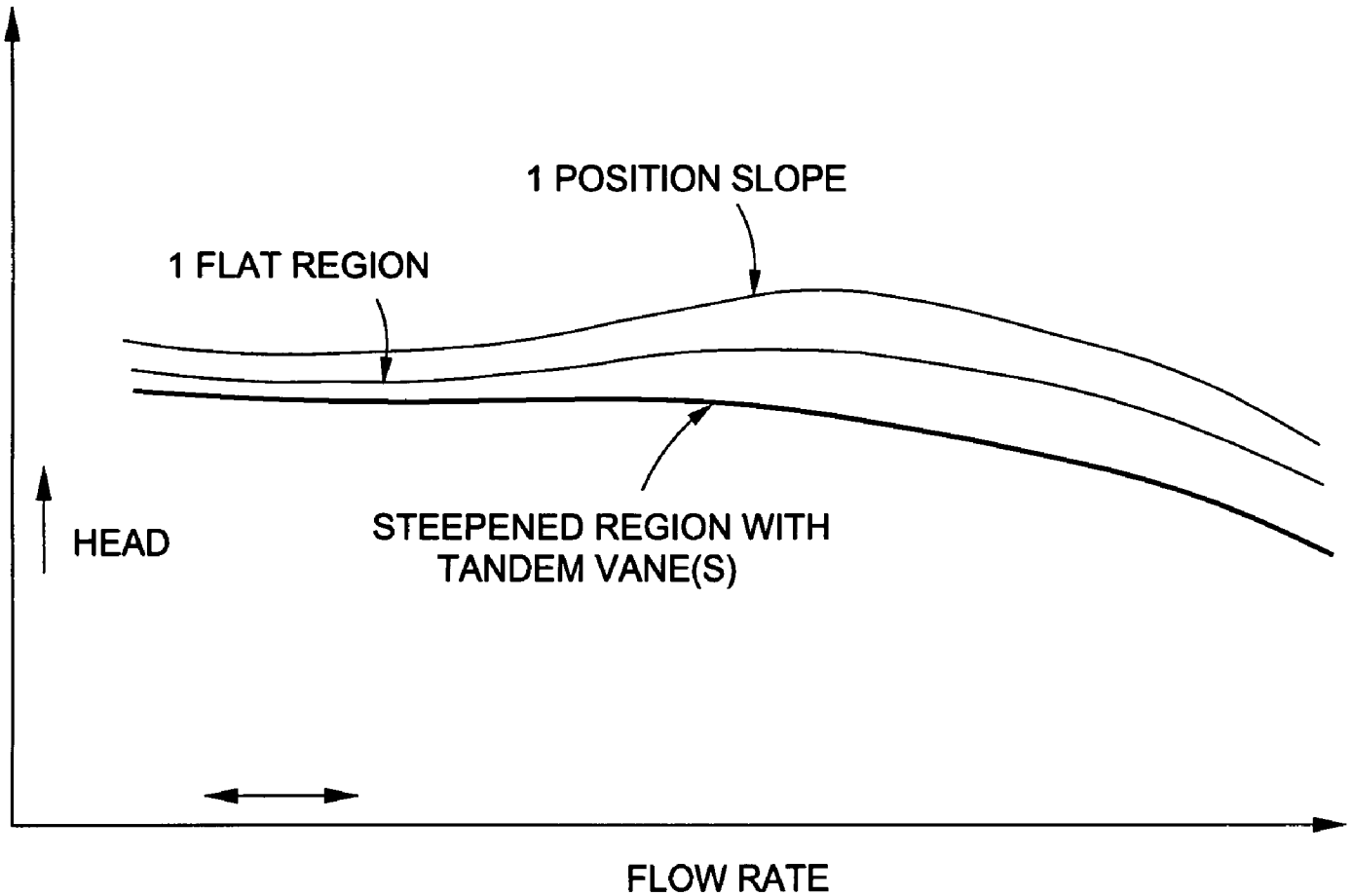
FIG. 14 is a graphical illustration of the pump head v. flow rate illustrating the influence of the tandem vane on the flow-head curve shape in the case of an unstable curve having a positive slope or flat curve.

As noted in conjunction with FIG. 14 it must first be determined if the flow-head curve for a particular centrifugal pump needs correction or not and how best to manipulate the fluid flow in the cross-over gap between the impeller and the axial diffuser so that the flow-head curve becomes continuously rising toward shut-off as illustrated in FIG. 14. As illustrated the correction is designed to eliminate a flat region or a positive slope.

Figure 1:
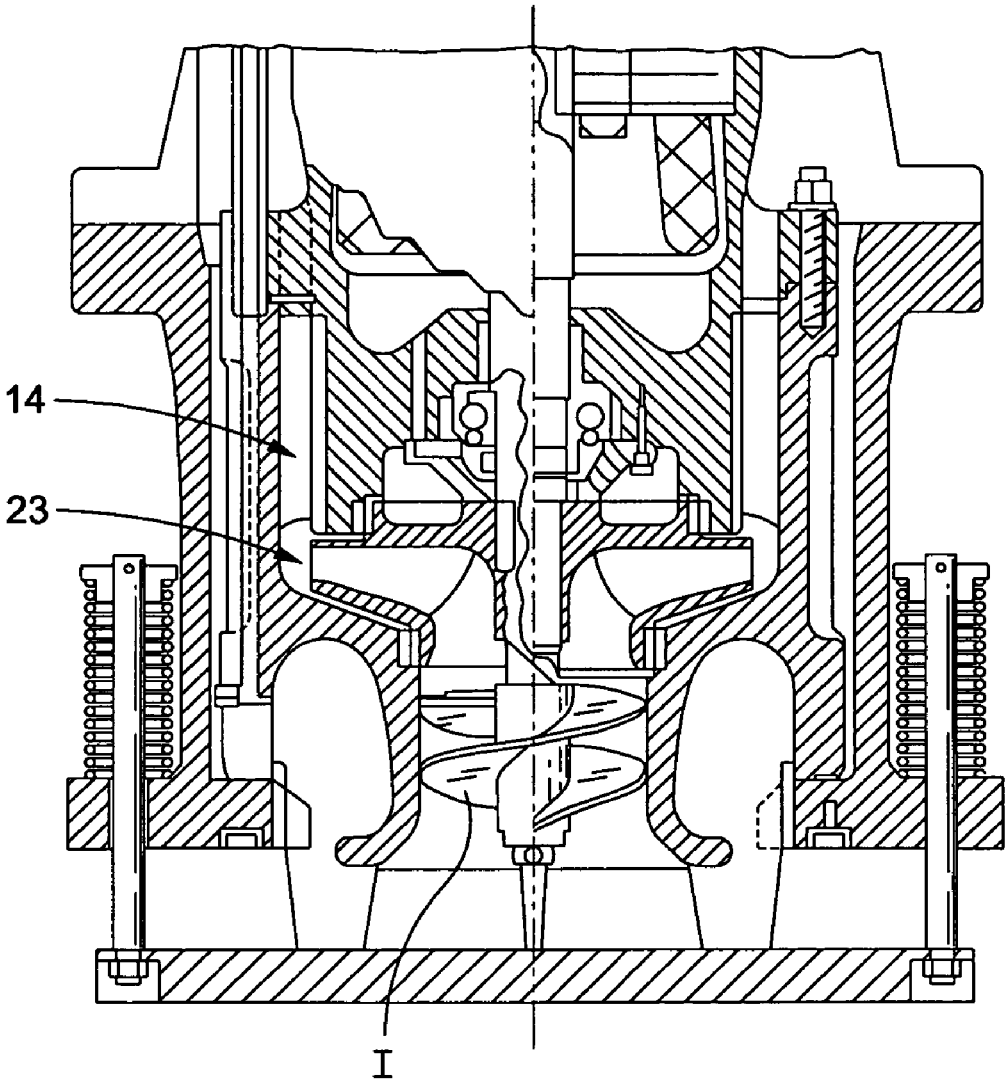
Fig. 1 (PRIOR ART)
FIG. 1 is a partial, general image of a submerged, cryogenic, centrifugal pump utilizing an axial diffuser, illustrative of the cross-over gap between the impeller and axial diffuser of a prior art In-tank type of LNG installation wherein the centrifugal pump is mounted at the bottom of a column.
Figure 2:
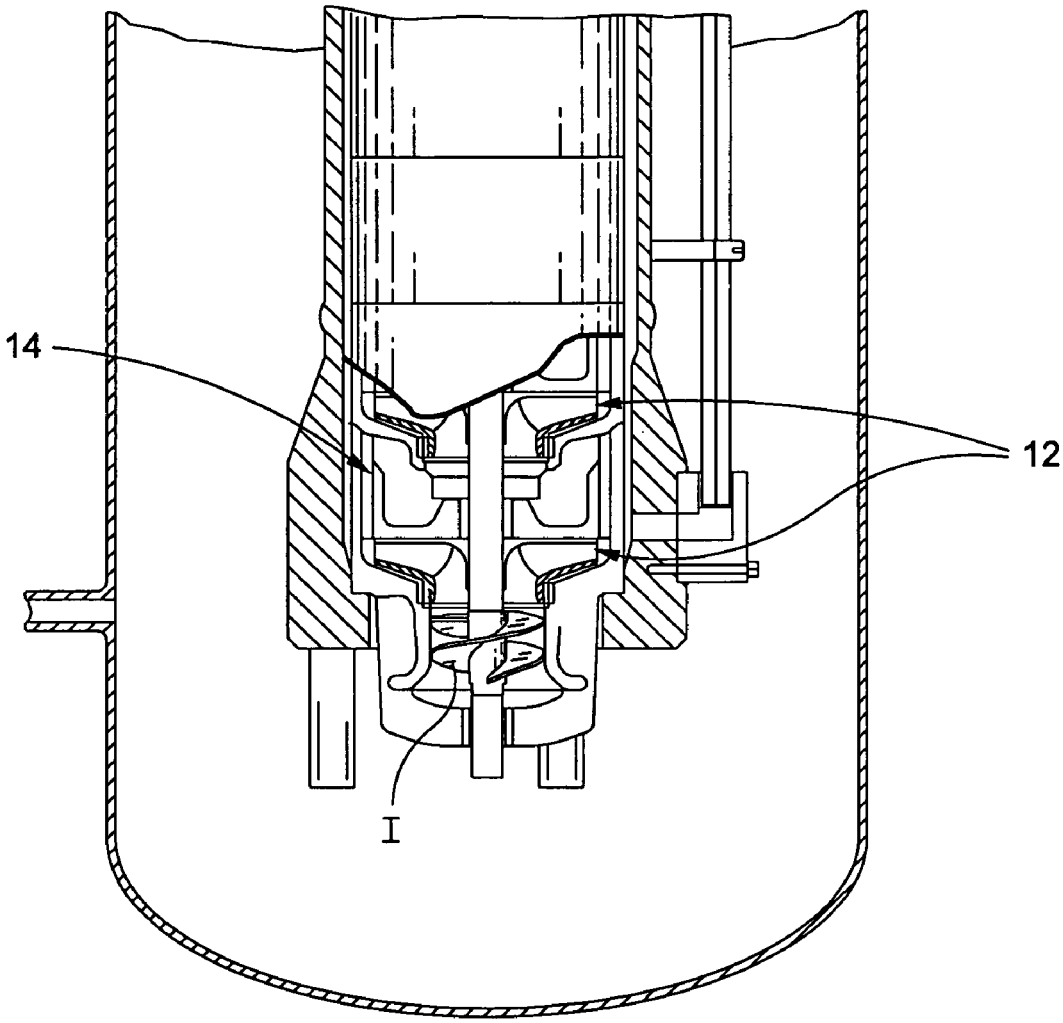
Fig. 2 (PRIOR ART)
FIG. 2 is a partial, general image of a submerged cryogenic centrifugal pump utilizing an axial diffuser illustrating the pot mounted or canned prior art LNG installation that illustrates the spacing between the impeller and axial diffuser.
Figure 3:
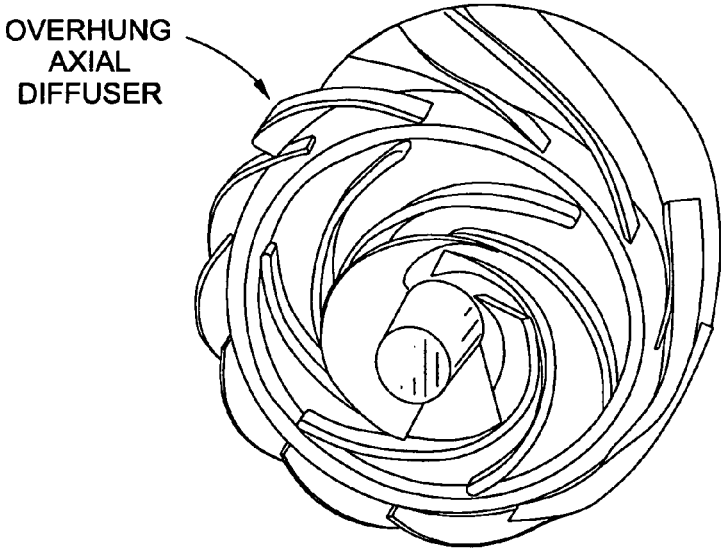
FIG. 3 is a front view of a cryogenic pump impeller, with the front shroud removed, and illustrating a tandem, full height single vane for an overhung diffuser vane which extends the axial diffuser leading edge into the cross-over gap between the impeller and the axial diffuser and embodying the present invention.
Figure 4:
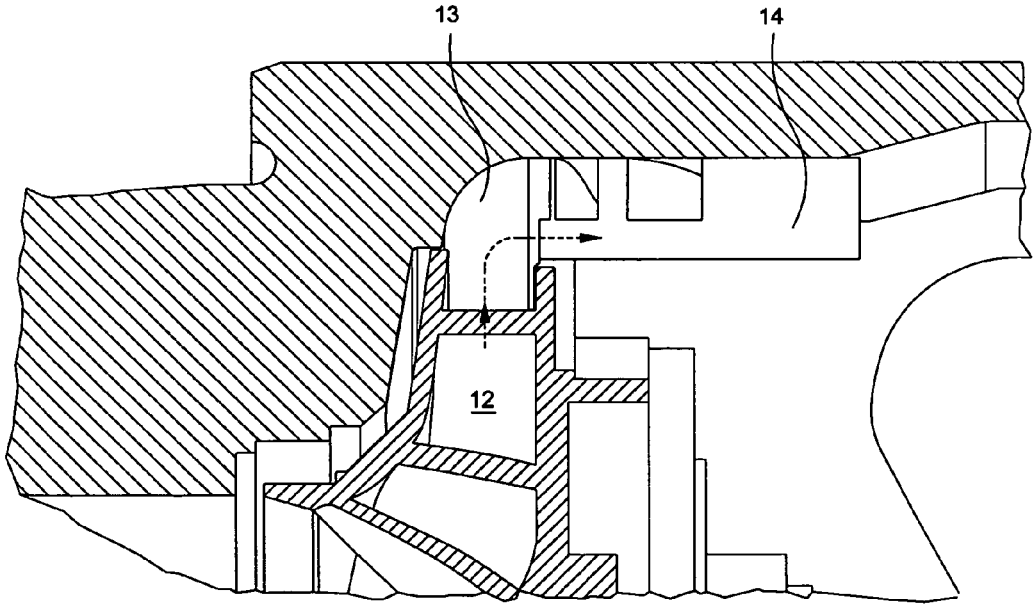
FIG. 4 is an enlarged, sectional view of a standard centrifugal pump construction having an inducer, impeller, cross-over gap and axial diffuser prior to addition of tandem vane secured thereto in accordance with the present invention.
Figure 5:
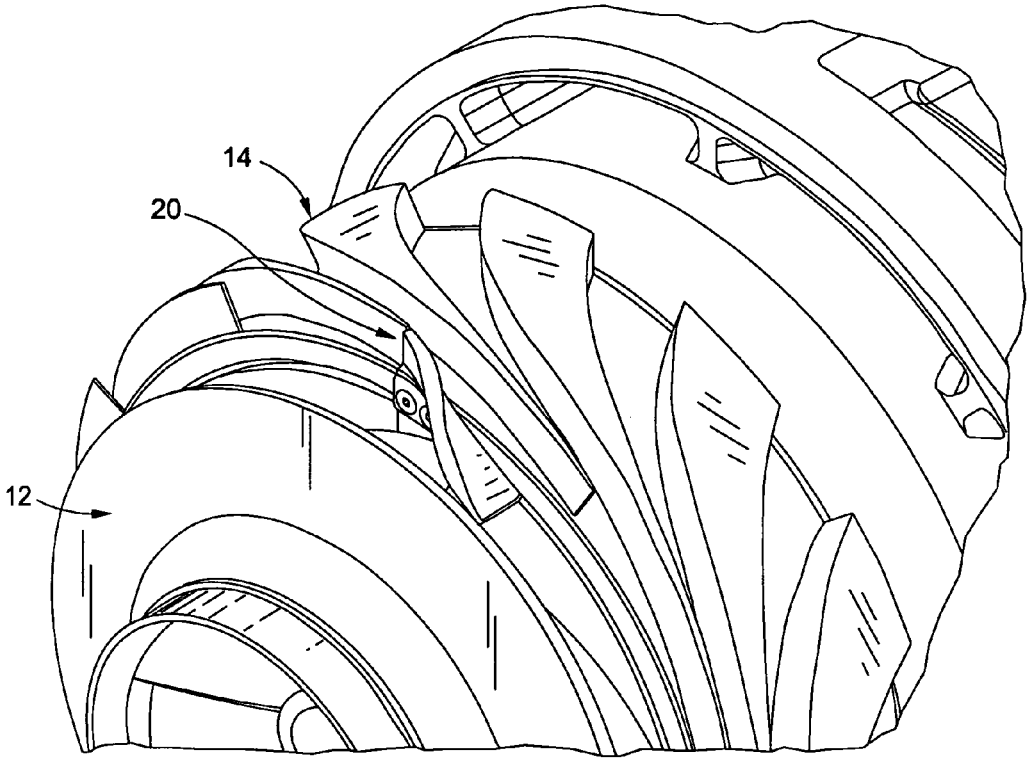
FIG. 5 is an overview of a centrifugal pump in combination with an axial diffuser with a tandem full height vane secured thereto and embodying the present invention.
Figure 6:
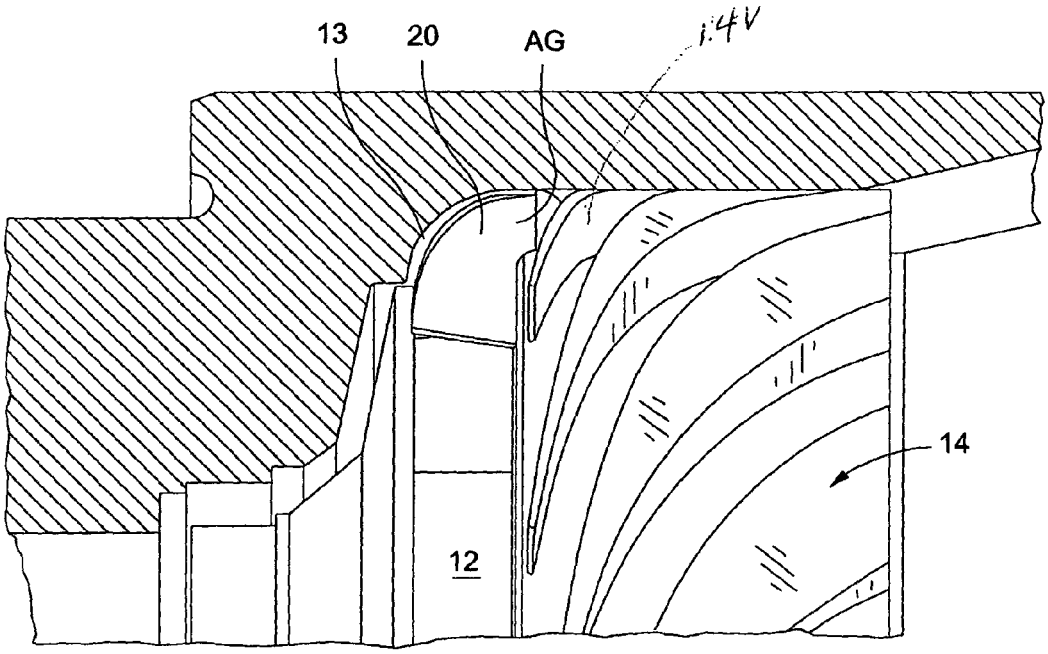
FIG. 6 is a meridian view of the tandem, full height vane(s) that fills the cross-over gap guides fluid from the impeller into the diffuser in accordance with the teachings of the present invention.
Figure 7:
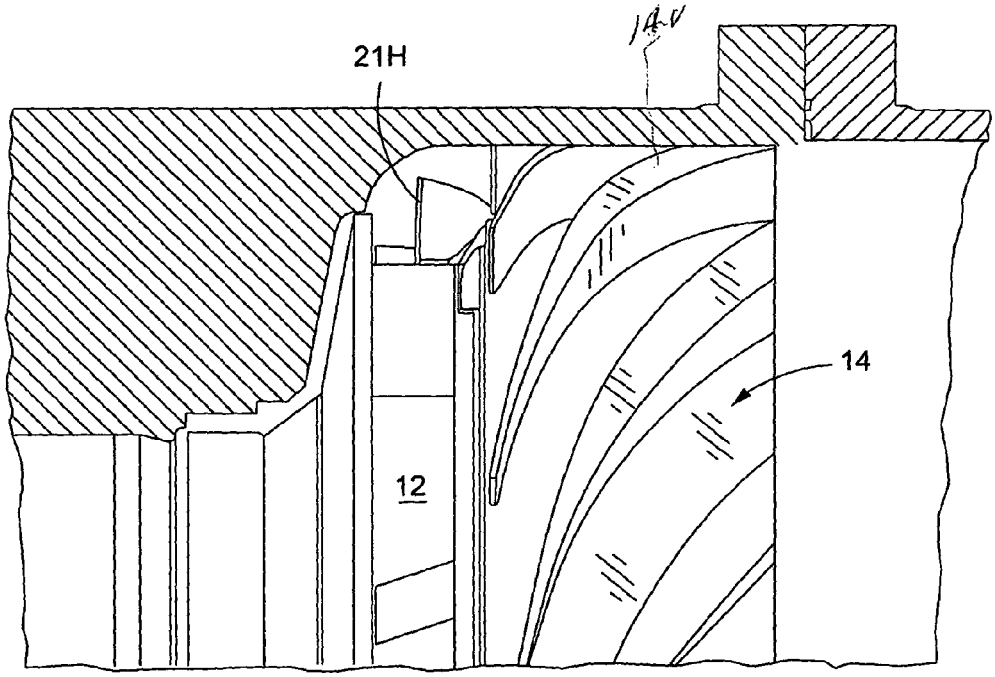
FIG. 7 is a meridian view of a half height vane(s) that partially fills the cross-over gap, as needed to best stabilize the head curve and embodying another embodiment of the invention.
Figure 8:
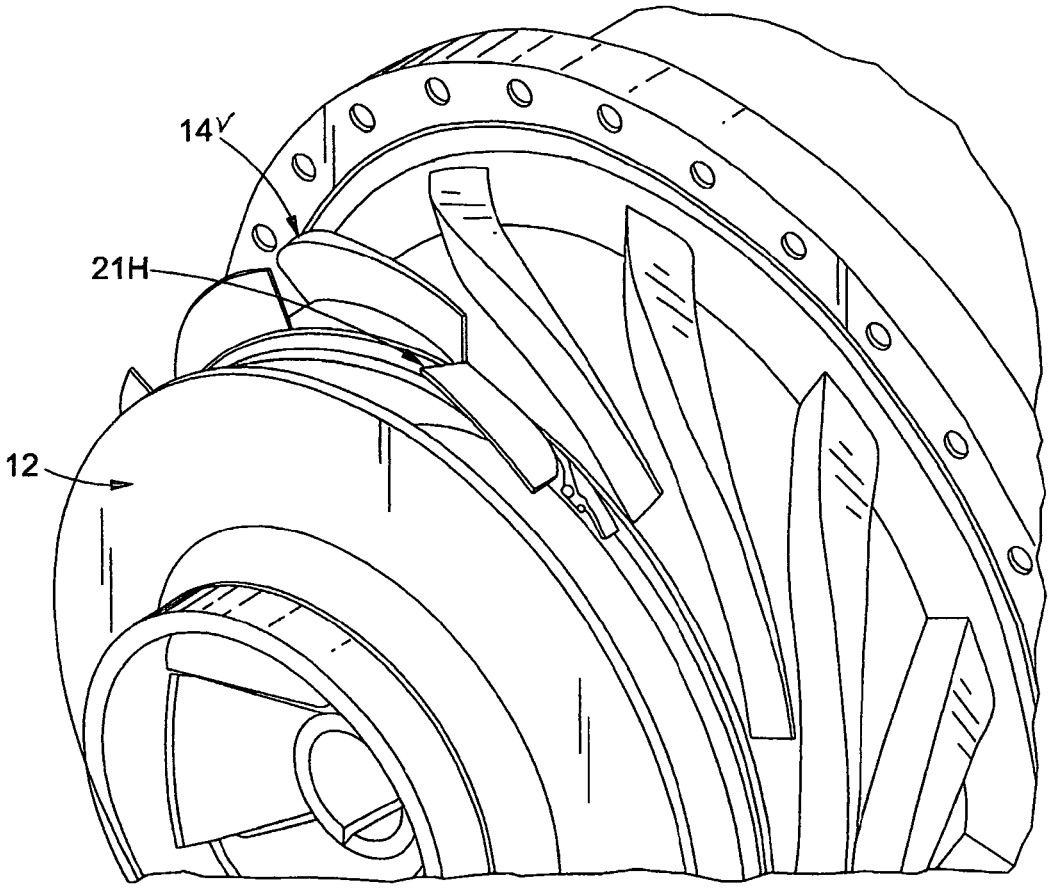
FIG. 8 is an overview of a conventional centrifugal pump with an axial diffuser stabilized by a half or partial height vane in accordance with the present invention.

The cross-over gap between the centrifugal pump impeller and axial diffuser as illustrated in FIGS. 1 and 2 is enlarged in the sectional view of FIG. 4 for a standard pump construction having an inducer 10, and impeller 12 spaced immediately below the cross-over gap 13 and spaced at an angular relationship with the axial diffuser 14. The cross overgap 13 is a ring of free space formed within the pump housing by the pump housing, the housing for the impeller 12 and diffuser 14 as seen in FIG. 4 of the standard pump construction. From this enlarged sectional overview, it can be better appreciated that the fluid from the impeller must drive the fluid from the impeller 12 into the cross-over gap 13 and must change direction from a vertical path in the drawing and turn through approximately 90 degrees in order to enter the diffuser 14. For this purpose, the vane extensions extend the axial diffuser leading edge into the cross-over gap 13 as noted in FIG. 3 by the legend "overhung axial diffuser". The pump provided with the axial diffuser in combination with the tandem, full height vane 20 that fills up the cross-over gap 13 as illustrated in FIG. 5. The tandem vane 20 adds an important item as the vane 20 has its leading edge skewed a pre-selected amount to produce a twisting action on the fluid received from the impeller 12 including any turbulence or vortices or eddies and the like that may have been generated therein. This twisting action is added in the cavity formed between the impeller 12 and axial diffuser 14 and has been effective to eliminate surging in the fluid, recirculation of the vortex and any tendency for the pump to stall during its entire operating range and make the flow-head curve steepened at the irregular areas. This tandem vane 20 by adding the twisting action to the fluid flow forces the circulating fluid to be guided into the axial diffuser 14. This is the described action for a single extension vane. The extension vane(s) are arranged circumferentially with the axial diffuser and can be secured to the diffuser. The vanes are constructed of a metal with a smooth surface for guiding the fluid stream from the impeller into the axial diffuser and for making the direction change in the meridian flow direction less abrupt. The extension vanes may be mounted separately from the diffuser in the cross-over gap and aligned circumferentially with the axial diffuser 14. The tandem vane 20 may be of a different geometric shape. The vane 14V of FIG. 5 is illustrated as a full height vane meaning that the vane 14 spans the entire passage in the cross-over gap and fills up the gap as illustrated in FIG. 5. As shown in FIG. 6, the tandem vanes 20 are arranged to provide a small axial gap AG between the tandem vane and the downstream axial diffuser vanes 14V. This is the function and arrangement of a single extension vane 20 but the concept is not limited to a single vane but may involve a plurality of spaced tandem vanes extending into the cross-over gap 13 between the impeller and diffuser to multiply the action of a single gap as it appears best for correcting the flow-head curve for the pump. The meridian view of the tandem full height vane(s) is illustrated in FIG. 6, An alternate geometric shape is a partial height vane(s) or a half height vane(s) 21H that partially fills the cross-over gap is illustrated in FIG. 7 as the meridian view thereof. The overall view of the centrifugal pump with the half height vane 21H is illustrated in FIG. 8. The small axial gap AG is maintained between the tandem vane and the downstream axial diffuser vanes. The use of a selected shape for the extension vane(s) is dependent on the type of correction required by the flow head curve to best stabilize the head curve. The concept of the present invention is not limited to ½ height or ¼ height but may be any fraction of the full height of the cross-over gap as it has been determined is necessary to best stabilize the head curve or any combination of the disclosed combination of features.

Figure 9:
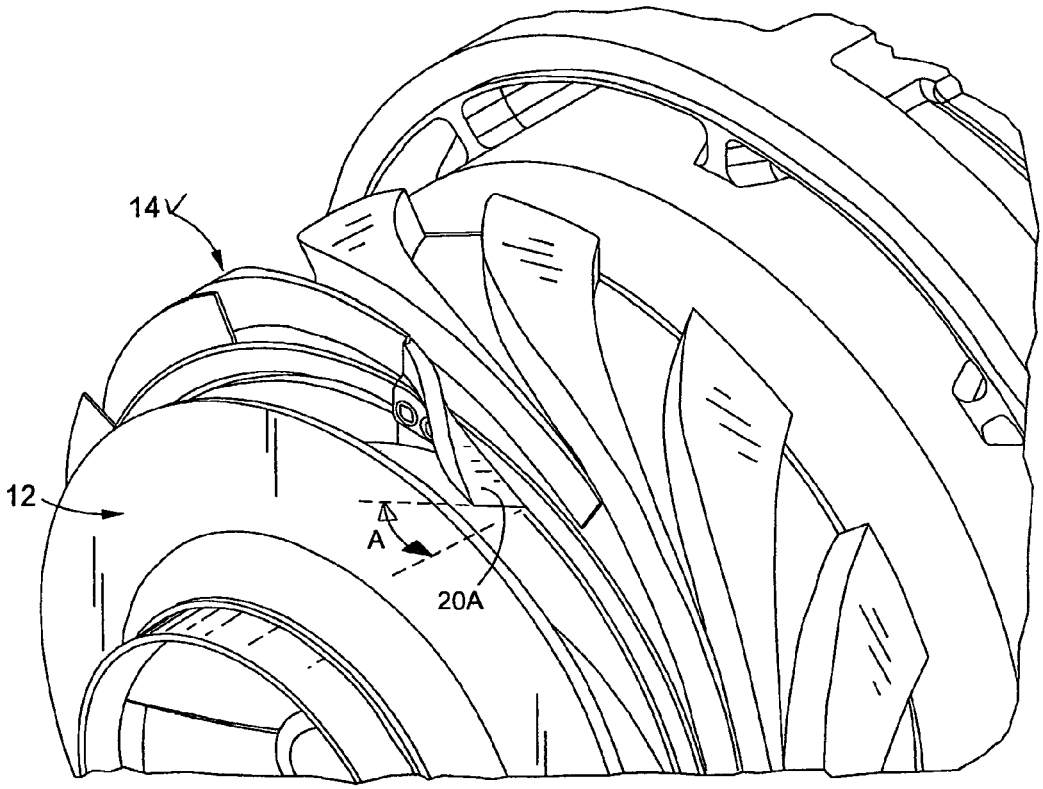
FIG. 9 is an angled or skewed full height vane(s) at the discharge end that partially fills the cross-over gap, as needed, to best stabilize the pump head curve.
Figure 10:
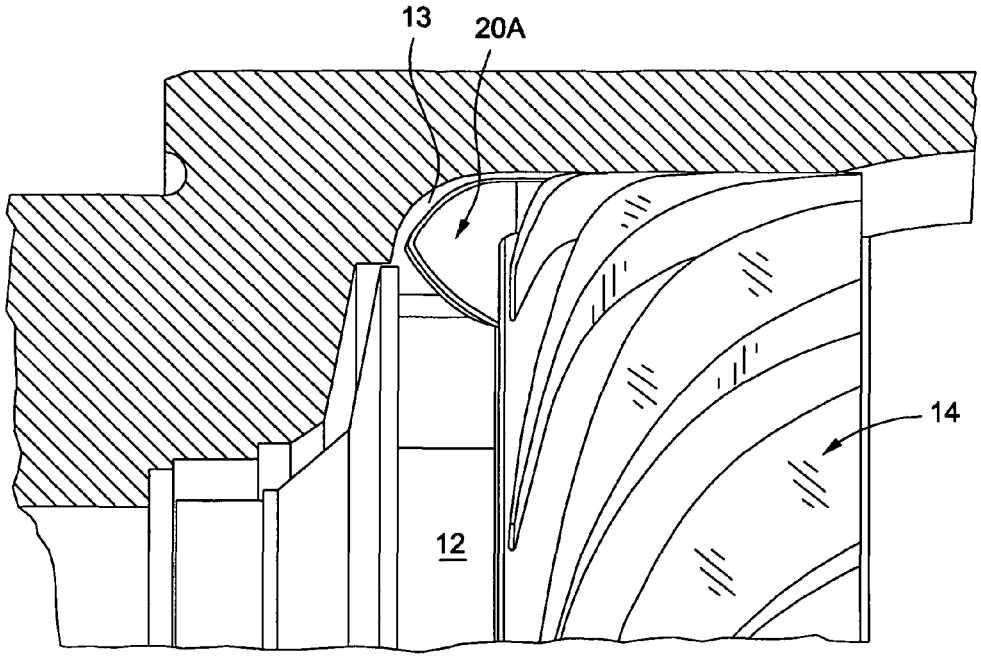
FIG. 10 is a meridian view of the tandem, angled, full height vane(s) of FIG. 9 that partially fills the cross-over gap, as necessary, to best stabilize the pump head curve.
Figure 11:
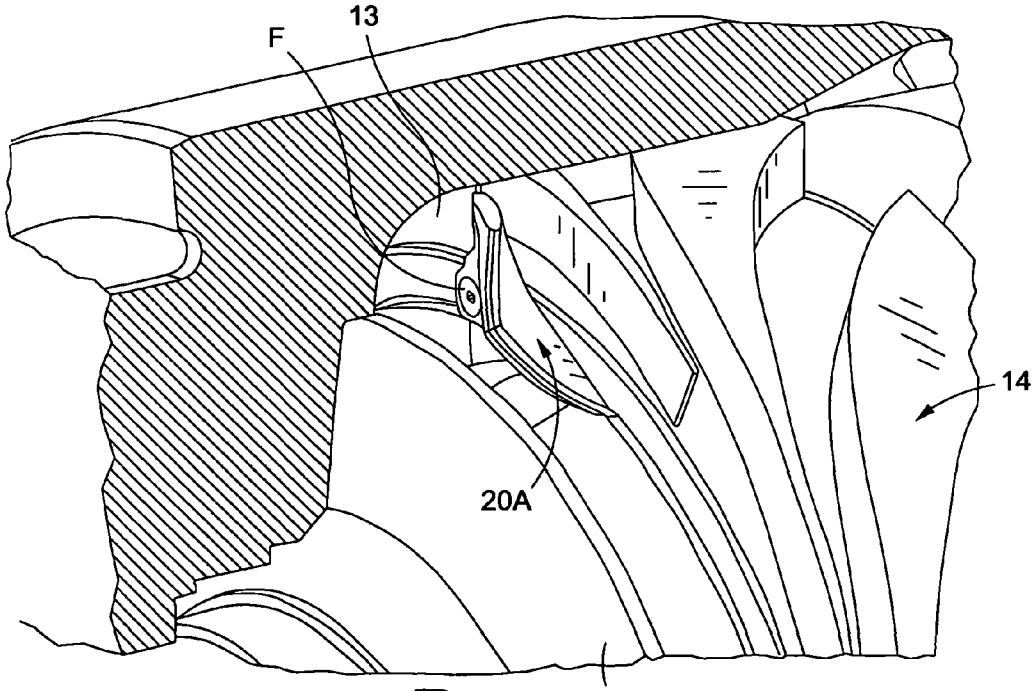
FIG. 11 is an overview of the tandem angled full height vane(s) of FIG. 10 that partially fills the cross-over gap.

FIGS. 9 and 10 illustrate a tandem, angled full height vane 14A with the overview of the pump in FIG. 9 while FIG. 10 is the meridian view of the tandem, angled full height vane 20A while maintaining the small axial gap AG, that partially fills the cross-over gap. The skewed leading edges 20A has a pre-selected angle A that is determined to best stabilize the head curve depending on the angle A of the tandem vane. The vane 20A is illustrated in FIG. 11 secured to the axial diffuser 14 by a fastener F.

Figure 12:
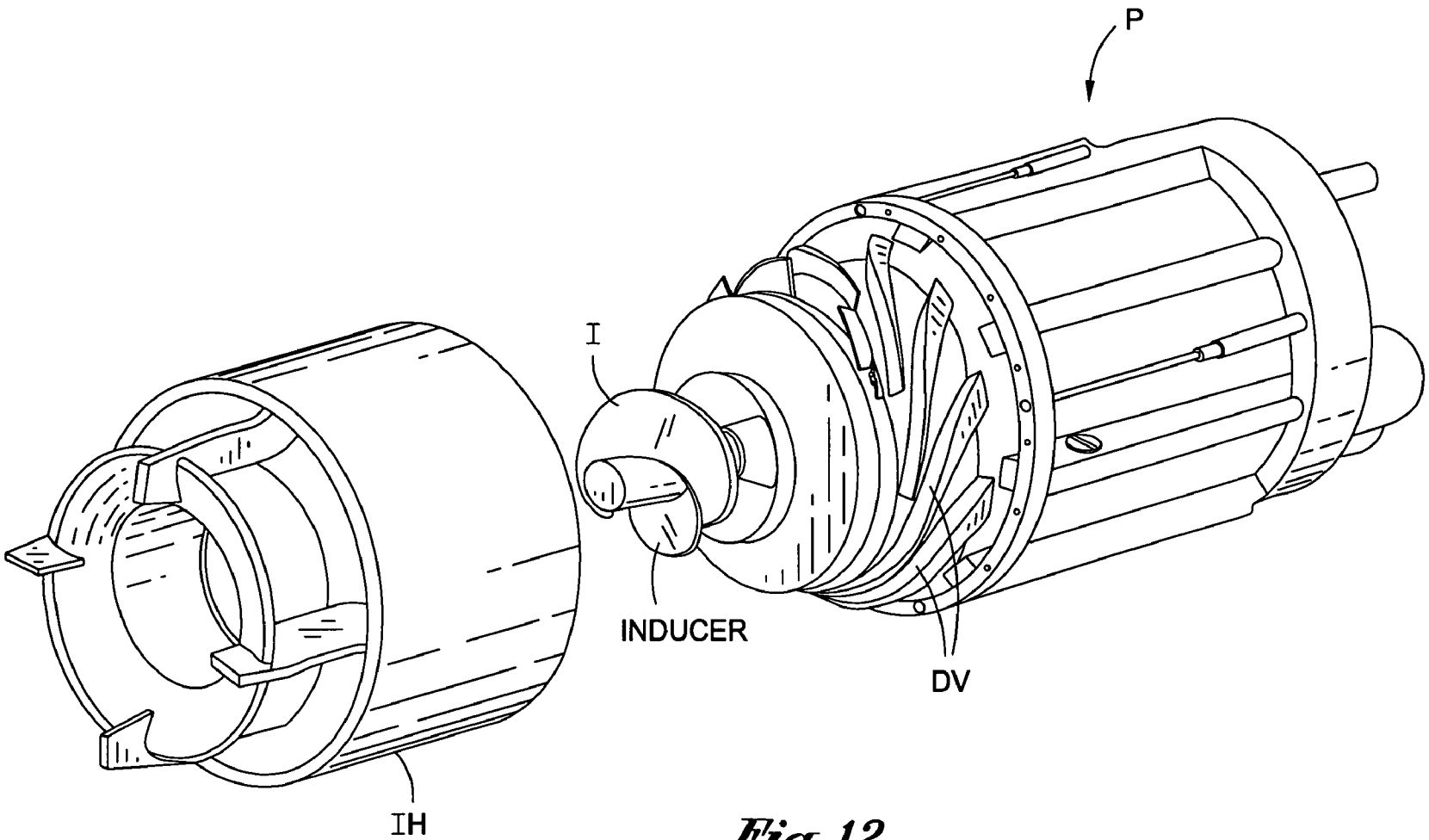
FIG. 12 is an overview of a retractable centrifugal pump in combination with an axial diffuser vane in an exploded view with the inlet casing of the invention.
Figure 13:
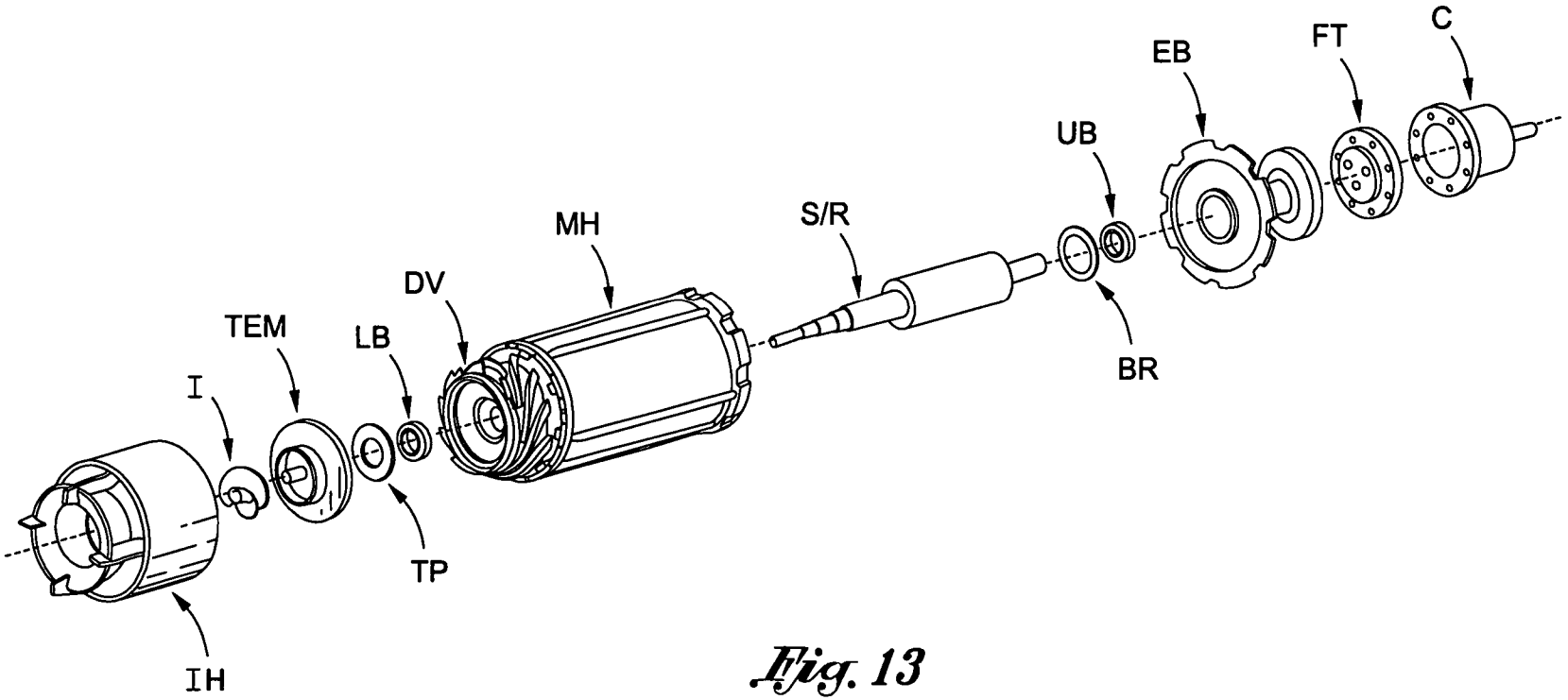
FIG. 13 is an exploded view of the complete centrifugal pump assembly with diffuser, inducer, inlet housing assembly and shaft/rotor assembly in accordance with the teachings of the present invention.

FIG. 12 is an overview of a retractable pump P as may be utilized for a LNG installation as the submerged cryogenic pump P for an In-tank or a canned application of the type illustrated in FIGS. 1 and 2, respectively. FIG. 12 illustrates an inducer I mounted to the end of the pump shaft and the exploded view revealing the end of the pump shaft and the exploded view revealing the axial diffuser vane DV. The inlet housing assembly IH is illustrated to the left, in an exploded fashion of the inducer I. The entire pump assembly is illustrated in an exploded fashion in FIG. 13 wherein pump motor assembly MH is shown with the spaced shaft/rotor assembly S/R showing the diffuser vanes DV (as in FIG. 12) and the inducer I adjacent the inlet housing assembly IH. The exploded view of FIG. 13 also includes a thrust equalizing assembly TEM adjacent the inducer I. The shaft/Rotor S/R is arranged with a bearing retainer BR, upper bearing UB, an end bell assembly EB, an electrical feed through assembly FT and a terminal cover C.

FIG. 14 illustrates a typical Head-flow curve for a centrifugal pump that may have regions requiring correcting, namely a flat region and/or a positive slope. This illustrates the influence of the tandem vanes of the present invention have on the shape and flow-head curve for a unstable curve.

With the above concepts in mind for manipulating the head curve shape the selection of the shape of the means for producing the desired shape for best stabilizing the head curve, at the present status of the art requires that the various structures must be tried for permitting the selection of the structure to best stabilize the head curve and on that basis select the configuration that produces the desired results. It will be recalled that the disclosed structures have certain angles for various ones of the means for producing the desired results but are not specifically detailed because they are dependent on the individual impeller and diffuser blade angles of the individual pump and determined on that basis.

It is known that unstable head curve performance or unstable hypteresis occur approximately 60% and 80% of the best efficiencing pump flow rate. The leading edge of the twisted vane is provided with an angle to match the angle of absolute flow while the trailing edge of the twisted vane is matched to the angle of the diffuser vane. It therefore can be appreciated that the individual working in this field will recognize that the range of angles or type of angle depends upon the design and configuration of the impeller for an individual pump and the design of the diffuser blade to be utilized therewith. With further development it is expected that a selection may be made be made without the need for implementing each structure for manipulating head curve for making the selection for the best flow rates.

The details of the pump head curve must also be known and dictates the action required to modify the head curve and omit the areas of flat curve or instability in the resulting head curve for the individual centrifugal pump.

The invention claimed is:

1. In a centrifugal pump housing including a rotatable impeller having radial blades and an axial diffuser having vanes angularly spaced downstream of said impeller by a cross-overgap formed within said pump housing so that the fluid subjected to the impeller must move through said cross-over gap to be driven into said axial diffuser, the improvement comprising at least a single, axial diffuser vane extension mounted circumferentially with said axial diffuser and extending into said cross-over gap for guiding the fluid flow from said impeller through the cross-over gap and driven to said axial diffuser, said diffuser vane extension being constructed designed and formed in structure with a tandem vane portion for imparting a twisting force to the fluid received from said impeller for minimizing any turbulence present in the fluid stream as it leaves the impeller whereby said pump exhibits a pump head curve that has been modified for eliminating flat or positive slopes as the flow-head curve becomes continuously rising toward shut-off.

2. In a centrifugal pump as defined in claim 1, wherein said diffuser vane has a full height vane spanning the entire distance in the cross-over gap between said impeller and the axial diffuser vane except a small axial gap between the tandem vane and the downstream axial diffuser vanes.

3. In centrifugal pump as defined in claim 1 wherein said axial diffuser vane extension comprise a plurality of full height tandem vanes for guiding the fluid in the region from the impeller into the axial diffuser to render the direction change of the fluid in the cross-over gap less abrupt.

4. In a centrifugal pump as defined in claim 1 wherein said diffuser vane extension has a partial height vane filling the cross-over gap as required to best stabilize the pump's head curve.

5. In a centrifugal pump as defined in claim 4 wherein said partial height vane is one half of the height of said cross-over gap.

6. In a centrifugal pump as defined in claim 1 wherein said diffuser vane has a full height of the cross-over gap but of a pre-selected portion of the cross-over gap and leading angle of tandem vane selected for improving the pump head curve.

7. In a centrifugal pump housing wherein said pump is pressure regulated for controlling the pump comprising an impeller within said pump housing for providing the fluid to be pumped and angularly spaced from an axial diffuser having vanes by an axial gap formed within the pump housing between the axial diffuser housing and the impeller housing cause the fluid exiting said impeller to be driven through the axial gap to said axial diffuser, the diffuser is constructed, defined and structured for converting the kinetic energy exiting impeller into static pressure with the least possible losses, the improvement comprising a single or a plurality of axial tandem vane extensions mounted circumferentially with said axial diffuser and extending a pre-selected distance into said crossover gap for maintaining stable operation of the pump by introducing a twisting movement into the fluid flow from said impeller for reducing any vortices or eddies in the fluid stream exiting the impeller to thereby adjust the pump head curve without any "flats" or positive slopes yet maintaining a pre-selected small axial gap between the exit of the tandem vane and the downstream axial diffuser vanes.

8. In a centrifugal pump as defined in claim 7 wherein said axial vane extensions are selected from a group of 1) full height extensions, 2) one-half extension or partial height extensions for manipulating the pump head curve for the best operation for pressure regulating of said pump.

9. A method of operating a centrifugal pump by pressure regulation to cause the pump to exhibit a stable characteristic evidenced by a pump flow-head curve that is adjusted to be continuously and smoothly rising to a shut-off condition, said pump including impeller means and an axial diffuser spaced from said impeller by a cross-over gap for receiving a fluid stream introduced into the pump by means of said impeller and including mounting a pre-selected axial diffuser vane extension a pre-selected distance into said cross-over gap for minimizing any turbulence in the fluid stream by varying the height of the axial extension and/or the length of the extension while maintaining a small axial gap between the exit end of the vane extension and the entry into said axial diffuser while determining the optimum dimensions for said vane extensions as exhibited by the pump head curves generated.

10. A centrifugal pump housing at cryogenic temperatures comprising a rotatable impeller having radial blades and an axial diffuser with vanes spaced downstream of said impeller in a pre-selected angular relationship with the fluid discharge end of said impeller by a cross-over gap defined within the pump housing to cause the fluid stream emitted from the impeller to be driven through the cross-over gap into said diffuser vanes, a single(s) vane secured to said pump housing outwardly of said impeller and circumferentially aligned with said diffuser vanes extending into the gap between the discharge end of the impeller for guiding the fluid flow through to the axial diffuser including causing the fluid to change direction for reaching the diffuser while maintaining a small axial gap between the singular vane and the downstream diffuser vanes.

11. In a submerged cryogenic centrifugal pump housing for correcting an undesirable head curve to one that is corrected to be continuously rising, steeper and more stable operating pump, said centrifugal pump housing comprising a rotatable impeller having radial blades and an axial diffuser having vanes angularly spaced relative to said impeller so that fluid expelled from said impeller must move through a cross-over gap defined in said housing for entry into said diffuser, a tandem vane extender secured to said pump housing and circumferentially mounted with said diffuser and extending into said cross-over gap for guiding the fluid conveyed by said impeller into said axial diffuser, said tandem vane extender having a discharge end constructed for imparting a twisting motion to the fluid conveyed thereby, said vane extender being mounted in tandem with the vanes for said axial diffuser for conveying and guiding the fluid received from said impeller vanes, said tandem vanes being selected to have height between one that fill up the cross-over gap and the selected partial height of said gap to best stabilize the head curve dependent on the undesirable portion and nature of said portion, said tandem vane being sized for maintaining a small axial gap between the entry into said diffuser and the end of said tandem vane so that the twisting of fluid conveyed thereby minimizes any turbulence that may be present in the fluid stream as received from said impeller and is conveyed into said diffuser.

12. In a submerged, cryogenic centrifugal pump as described in claim 11 wherein said selected tandem vane comprises a plurality of tandem vanes.

13. In a submerged, cryogenic centrifugal pump housing for correcting an undesirable head curve to one that is corrected to be continuously rising, steeper and more stable operating pump, said centrifugal pump housing comprising a rotatable impeller having radial blades and an axial diffuser having vanes angularly spaced relative to said impeller so that fluid expelled from said impeller must move into a cross-over gap defined in said housing between the impeller and axial diffuser for entry into said diffuser, a tandem vane extender secured to said pump and circumferentially mounted with said diffuser and extending into said cross-over gap for guiding the fluid conveyed by said impeller into said axial diffuser, said tandem vane having a discharge end for imparting a twisting motion to the fluid conveyed thereby, said vane extender being mounted in tandem with the vanes for said axial diffuser for conveying and guiding the fluid received from said impeller vanes, said tandem vane being selected to have a height between one that completely fill up the cross-over gap and one that partially fills up the crossover gap and mounted with a pre-selected axial gap between said tandem vane and the axial diffuser.

14. In a submerged, cryogenic centrifugal pump as defined in claim 13 wherein the tandem vane selected has a height that completely fills up a portion of the cross-over gap at the leading edge of said tandem vane and maintains an angled gap from the trailing edge of said tandem vane to said impeller to best stabilize the head curve.

15. In a submerged, cryogenic centrifugal pump housing for correcting an undesirable head curve to one that is corrected to be continuously rising steeper and more stable operating pump, said centrifugal pump housing comprising a rotatable impeller having radial blades and an axial diffuser having vanes angularly spaced relative to said impeller by a crossover gap formed within said pump housing between the impeller and diffuser so that the fluid expelled from said impeller must move through the crossover gap defined in said pump housing for entry into said diffuser, a tandem vane extender secured to said pump housing and circumferentially mounted with said diffuser and extending into said crossover gap for guiding the fluid conveyed by said impeller into said axial diffuser, said tandem vane having a discharge end for imparting a twisting motion to the fluid conveyed thereby, said vane extender being mounted in tandem with the vanes for said axial diffuser for conveying and guiding the fluid received from said impeller vanes, the improvement comprising an axial vane diffuser having leading edge of said diffuser vanes extending into the cross-over gap between said impeller and the axial diffuser and wherein said diffuser vanes are constructed, designed for guiding the fluid received from said impeller through said cross-over path and into said diffuser.

16. A method of operating a centrifugal pump for maintaining a stable operation exhibited by a head curve without any flat portion or positive slopes including the steps of providing a centrifugal pump having a centrifugal impeller means and an axial diffuser spaced from said impeller means for receiving and bending the liquid flowing from said impeller means by a path through cross-over gap to said axial diffuser;

providing at least a singular vane extending a pre-selected distance from said diffuser into said cross-over gap for guiding and bending the liquid flow through the cross-over gap into the spaced axial diffuser by bending the liquid flowing from said impeller means towards said diffuser for stabilizing the operation of the pump throughout its operating range.

17. A method of operating a centrifugal pump as in claim 16 whereas said at least a single vane is secured to said axial diffuser and that is separate from said diffuser means and mounted to said pump circumferentially aligned with said diffuser means and designed, constructed, and structured to prevent the pump from operating with unstable and/or positive regions whereby the head curve for said pump is represented by a head curve that is continuously rising towards shut-off.

18. A method of operating a centrifugal pump structured for pressure regulation to achieve a stable operation of the pump evidenced by a pump head curve that does not exhibit any flat or positive slope portions, said centrifugal pump comprising a centrifugal impeller having radial blades operative to receive and discharge the fluid to be pumped, and an axial diffuser spaced from said impeller whereby the fluid to be pumped must move from said impeller upon discharge therefrom through the cross-over path between the impeller and said diffuser including through a change in direction for entering said axial diffuser, said axial diffuser having a plurality of axial vanes and structured for conveying the received fluid through said diffuser wherein the kinetic energy of the received fluid is converted at the diffuser to corresponding pressure energy, at least a single tandem vane mounted circumferentially with said diffuser and extending into said cross-over path, said tandem vane being designed for tandem mounting with said diffuser at one end and discharge section angularly related to the entry end of the extension and selected for minimizing any turbulence present in the fluid stream to achieve the stable operation of said pump as exhibited by a pump head characteristic that has been corrected for any flat or positive slopes by structuring said extension to achieve a steepened head curve continuously rising to shut-off and thereby usable for pressure controlled pump regulation.

19. A method of operating a centrifugal pump as defined in claim 18 wherein said tandem vane is secured to said diffuser and extends the axial diffuser leading edges to said diffuser and extends the axial diffuser leading edges into a-portion of said cross-over gap between the impeller and axial diffuser section.

20. A method of operating a centrifugal pump as defined in claim 18 wherein said tandem vane is mounted on said cross-over gap between the impeller and axial diffuser section.

21. A method of operating a centrifugal pump as defined in claim 18 or 19 wherein said tandem vane is designed and proportioned to fill the full height of the cross-over gap.

22. A method of operating a centrifugal pump as defined in claim 21 wherein said tandem vane comprises a plurality of tandem vanes.

* * * * *

UNITED STATES PATENT AND TRADEMARK OFFICE

CERTIFICATE OF CORRECTION

PATENT NO. : 8,240,976 B1
APPLICATION NO. : 12/381941
DATED : August 14, 2012
INVENTOR(S) : Keijun Kamio It is certified that error appears in the above-identified patent and that said Letters Patent is hereby corrected as shown below:

IN THE DRAWINGS

In Fig. 14: The Topmost Legend should be "Positive Slope"

Not "Position Slope"

Signed and Sealed this
Twenty-third Day of October, 2012

David J. Kappos
*Director of the United States Patent and Trademark Office*